US012060221B2

(12) United States Patent
Casotto et al.

(10) Patent No.: US 12,060,221 B2
(45) Date of Patent: Aug. 13, 2024

(54) SUBSEA STORAGE SYSTEM

(71) Applicant: SAIPEM S.P.A., San Donato Milanese (IT)

(72) Inventors: Marco Casotto, San Donato Milanese (IT); Sandro Matterazzo, San Donato Milanese (IT)

(73) Assignee: SAIPEM S.P.A., Milan (IT)

( * ) Notice: Subject to any disclaimer, the term of this patent is extended or adjusted under 35 U.S.C. 154(b) by 366 days.

(21) Appl. No.: 17/414,033

(22) PCT Filed: Dec. 12, 2019

(86) PCT No.: PCT/IB2019/061010
§ 371 (c)(1),
(2) Date: Jun. 15, 2021

(87) PCT Pub. No.: WO2020/128890
PCT Pub. Date: Jun. 25, 2020

(65) Prior Publication Data

US 2022/0024688 A1 Jan. 27, 2022

(30) Foreign Application Priority Data

Dec. 18, 2018 (IT) ..... 102018000020059

(51) Int. Cl.
*B65D 88/78* (2006.01)
*E21B 41/00* (2006.01)
*E21B 43/017* (2006.01)

(52) U.S. Cl.
CPC ..... *B65D 88/78* (2013.01); *E21B 41/0007* (2013.01); *E21B 43/017* (2013.01)

(58) Field of Classification Search
CPC ..... B65D 88/78; E21B 41/007; E21B 43/017; F17C 2221/033; F17C 1/00
See application file for complete search history.

(56) References Cited

U.S. PATENT DOCUMENTS

| | | | | |
|---|---|---|---|---|
| 3,869,388 A | | 3/1975 | Vennett | |
| 3,943,724 A | | 3/1976 | Banzoli et al. | |
| 4,374,478 A | * | 2/1983 | Secord | B65D 88/06 137/259 |
| 5,201,611 A | * | 4/1993 | Komaki | E21B 41/0007 405/185 |
| 6,089,027 A | * | 7/2000 | Wang | F17C 11/00 62/48.1 |

(Continued)

FOREIGN PATENT DOCUMENTS

WO 2011084164 A1 7/2011

OTHER PUBLICATIONS

Stanford; "Lecture 2: Properties of Water and Seawater"; All; Apr. 1, 2017 (Year: 2017).*

(Continued)

*Primary Examiner* — Benjamin F Fiorello
(74) *Attorney, Agent, or Firm* — CANTOR COLBURN LLP

(57) ABSTRACT

A method for compensating the bathymetric pressure inside a subsea tank containing a liquid working fluid by using a bathymetric compensation fluid is provided. The liquid working fluid and the bathymetric compensation fluid are separated from each other by a separation layer of a separation fluid.

15 Claims, 14 Drawing Sheets

(56) References Cited

U.S. PATENT DOCUMENTS

| | | | | |
|---|---|---|---|---|
| 7,448,404 | B2 | 11/2008 | Samuelsen et al. | |
| 8,905,677 | B2 * | 12/2014 | Hantz | B65D 88/78 405/203 |
| 2008/0041291 | A1 | 2/2008 | Horton et al. | |
| 2011/0013989 | A1 * | 1/2011 | Wu | E02B 17/021 405/210 |
| 2015/0246770 | A1 * | 9/2015 | Chang | F17C 1/007 405/207 |
| 2021/0053753 | A1 * | 2/2021 | Sun | B65D 88/54 |

OTHER PUBLICATIONS

International Search Report for International Patent Application No. PCT/IB2019/061010, mailed Feb. 17, 2020.
International Preliminary Report on Patentability for International Patent Application No. PCT/IB2019/061010, mailed Mar. 29, 2021.
Written Opinion for International Patent Application No. PCT/IB2019/061010, mailed Feb. 17, 2020.

* cited by examiner

SUBSEA STORAGE SYSTEM

CROSS-REFERENCE TO RELATED APPLICATIONS

This application is a National Phase Application of PCT International Application PCT/IB2019/061010, having an International Filing Date of Dec. 18, 2019 which claims priority to Italian Application No. 102018000020059 filed Dec. 18, 2018, each of which is hereby incorporated by reference in its entirety.

TECHNICAL FIELD

The application of the present disclosure is in the Oil & Gas sector, for the subsea storage of chemical products.

BACKGROUND

The use of subsea, and more in general subsea tanks, dates back to the last century, initially for storing fuels for military purposes, then for civilian activities, such as the temporary storage of petroleum to service oil platforms.

It is a normal fact that in rigid storage tanks, as they are progressively emptied, an empty volume left by the withdrawn liquid is created. In onshore or topside tanks, the empty volume is simply replaced by a gas represented by air, if the products involved are not hazardous, or by an inert gas, if they are flammable.

In subsea tanks, the volume left by the withdrawn liquid is not replaced by any gas, and this creates a technical problem that is difficult to solve. As a result of the vacuum thus left, the container has to contrast the external bathymetric pressure, which for example at one thousand meters amounts approximately to 102 bar a.

A consequence of this fact is the large thickness of the tank wall, and hence the use of high quantities of material for their construction.

To overcome this difficulty, various types of tanks have been designed and patented; they have in common the fact that the space left empty by the withdrawn liquid is replaced by seawater, which compensates bathymetric pressure.

The separation between water and stored chemical product is achieved by means of a membrane or a flexible/deformable container.

One of the first patents in this field dates back to 1976 (U.S. Pat. No. 3,943,724, Tecnomare) and it provides for the use of a polymeric dividing wall inside a metal tank to separate petroleum from seawater.

The more recent US patent (U.S. Pat. No. 7,448,404) describes a subsea tank formed by a spherical rigid structure with a flexible plastic balloon inside it to store crude oil in proximity to platforms.

Within the Oil & Gas field, the subsea storage of chemical products to be used is carried out with the methodologies already mentioned in the above referenced patents.

The main difficulty is tied to the bathymetric elevation and to the resistance of the tank to the pressure related to the depth at which it is positioned.

In practice, containers are never subjected to pressures comparable to bathymetric pressure: the maximum external pressure to which they are subjected is approximately 1 bar or little more.

This is achieved using seawater as compensation fluid, maintaining the chemical product separated by means of a membrane, usually plastic, which reduces its own volume according to the chemical product contained, causing the pressure difference at the two surfaces of the membrane to be practically nil.

Alternatively, the deformability of the tank itself is used to cause the empty volume to be nil, i.e. the volume of the rigid tank is reduced proportionately with the consumption of liquid.

As a consequence, the pressure inside the tank is practically equal to the pressure outside the tank, as applied in bellows tanks or in floating roof tank or in tanks similar to syringes/pistons, in which a face is displaced and the walls are deformed to follow the volume of the remaining chemical product like the plunger of a syringe.

Solutions based on the use of deformable containers made of polymeric material (for example, flexible bags, membranes, bellows) still do not solve the problems, because they clash with the issue of the compatibility of the material with the chemicals contained therein, which requires numerous experimental tests and does not guarantee the results against new chemicals that will be available in the future.

For "piston" solutions, instead, the problem is mainly that of ensuring the fabrication tolerances necessary for operation; moreover, when pistons have large size, the main drawbacks are those of blockage or of the loss of seal during their permanence under water.

The prior art document U.S. Pat. No. 3,869,388 describes a method for storing seawater and oil, two fluids that cannot be mixed together, by using a separation fluid, in order to avoid the contamination of the oil by microorganisms present in seawater; for this purpose, the barrier fluid may comprise an antimicrobic compounds.

The prior art document WO 2011/084164 describes a subsea tank positioned at the sea bottom for the storage of natural gas and seawater, to compensate changes in hydrostatic pressure, separated from each other from a liquid separation layer.

The prior art document US 2008/041291 describes a system for the subsea storage of gas, in which a liquid separation membrane may be provided, between said gas and the seawater used to compensate the emptying of the tank, such as to form an emulsion layer at the gas-liquid interface.

BRIEF SUMMARY

The inventors of the present patent application have surprisingly found that it is possible to separate the bathymetric compensation fluid, within a subsea tank for storing chemical products, by means of a barrier fluid, which is insoluble in said compensation fluid and in the chemical product.

The disclosure provides a method for compensating bathymetric pressure inside a subsea tank.

The disclosure provides a subsea tank that can be employed in the method of the disclosure.

The disclosure provides applications in the method of the disclosure, for example for transporting a tank to be located under water, for example on the sea bottom.

The method of the disclosure finds application in subsea compensators.

Figure 15A:
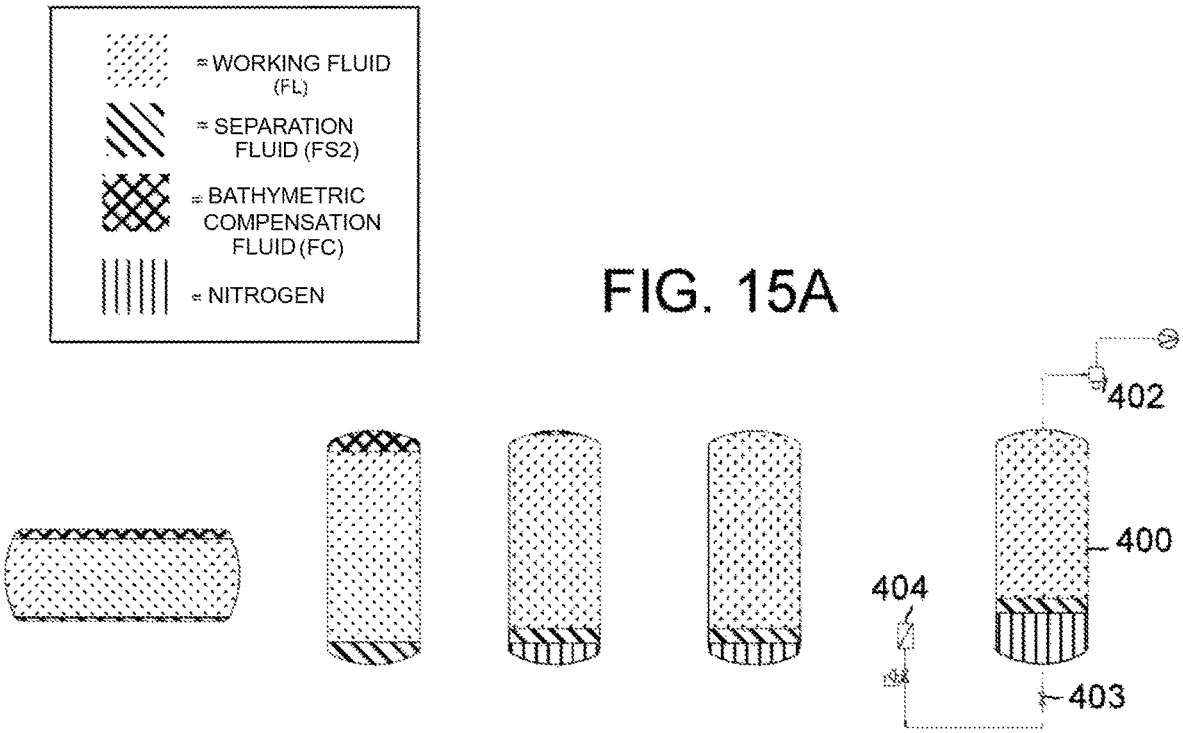
Figure 15B:
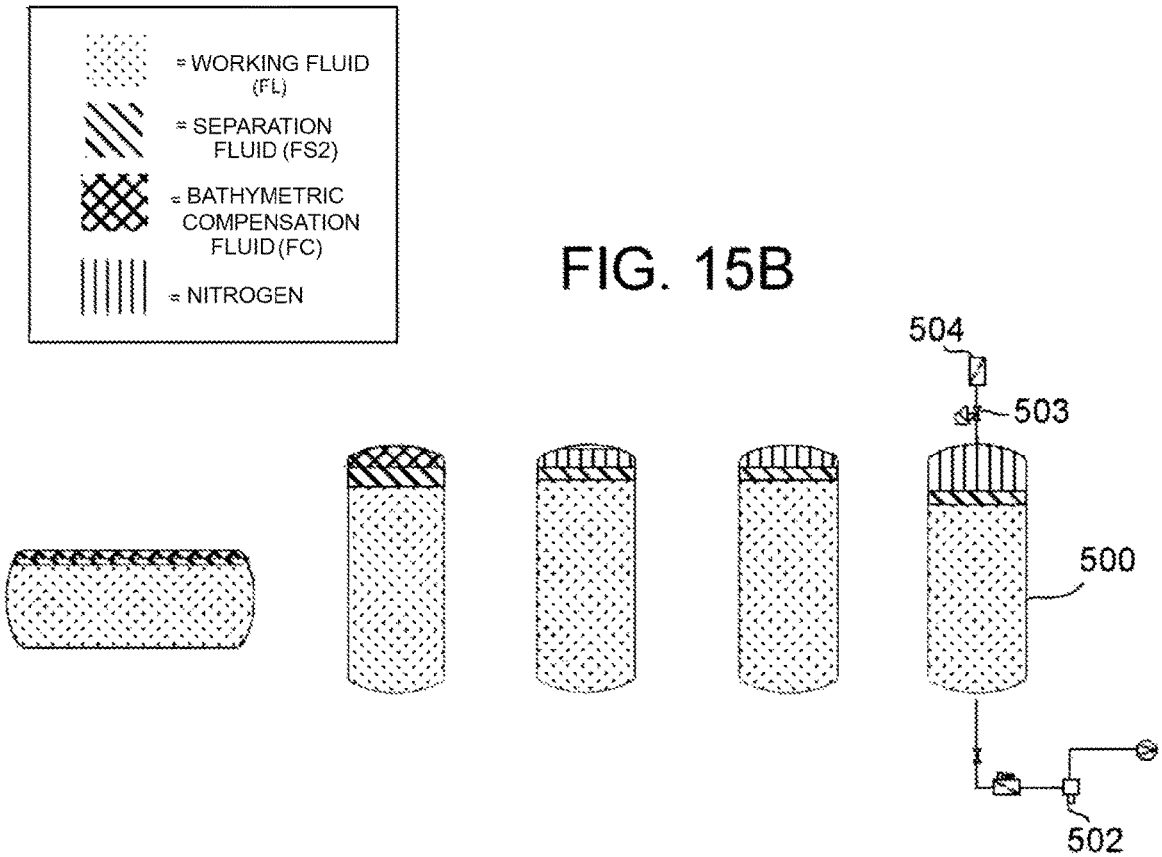
Figure 16:
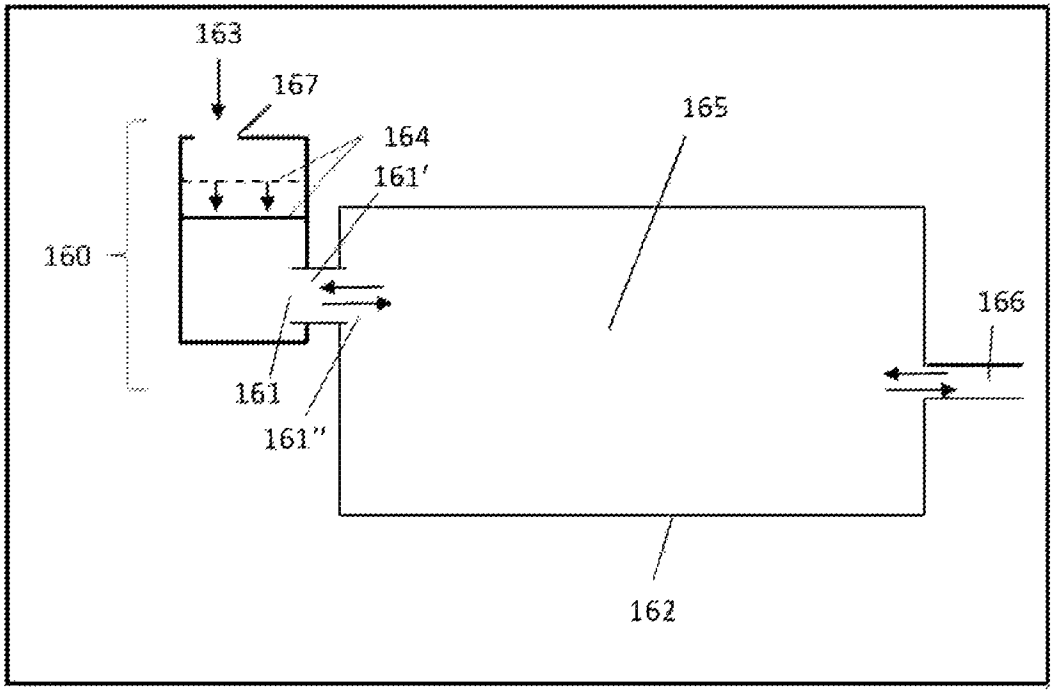
FIG. 16 PRIOR ART
Figure 17:
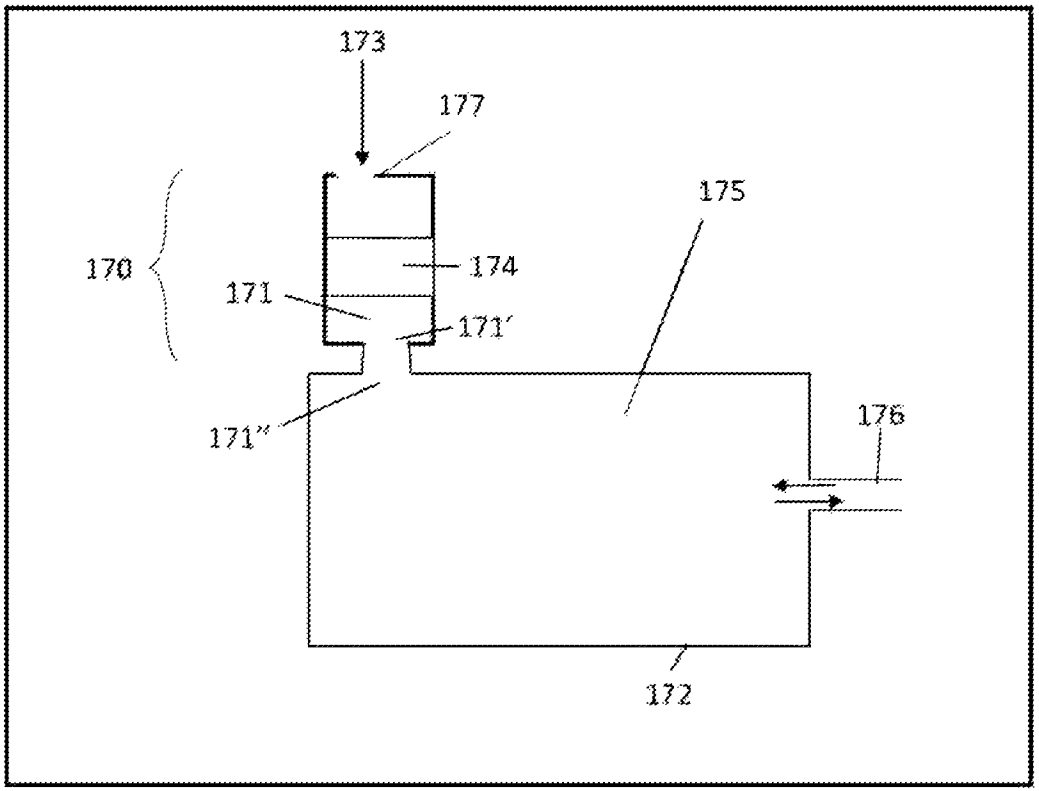
Figure 18:
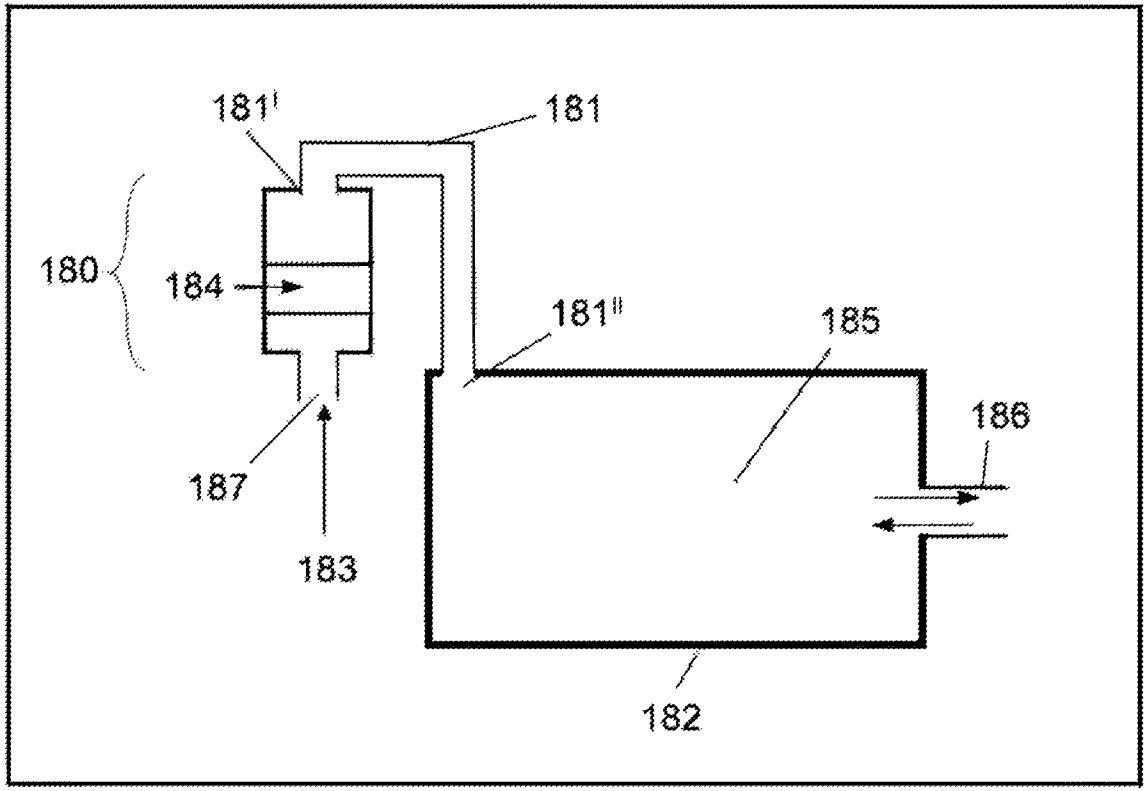
Figure 19:
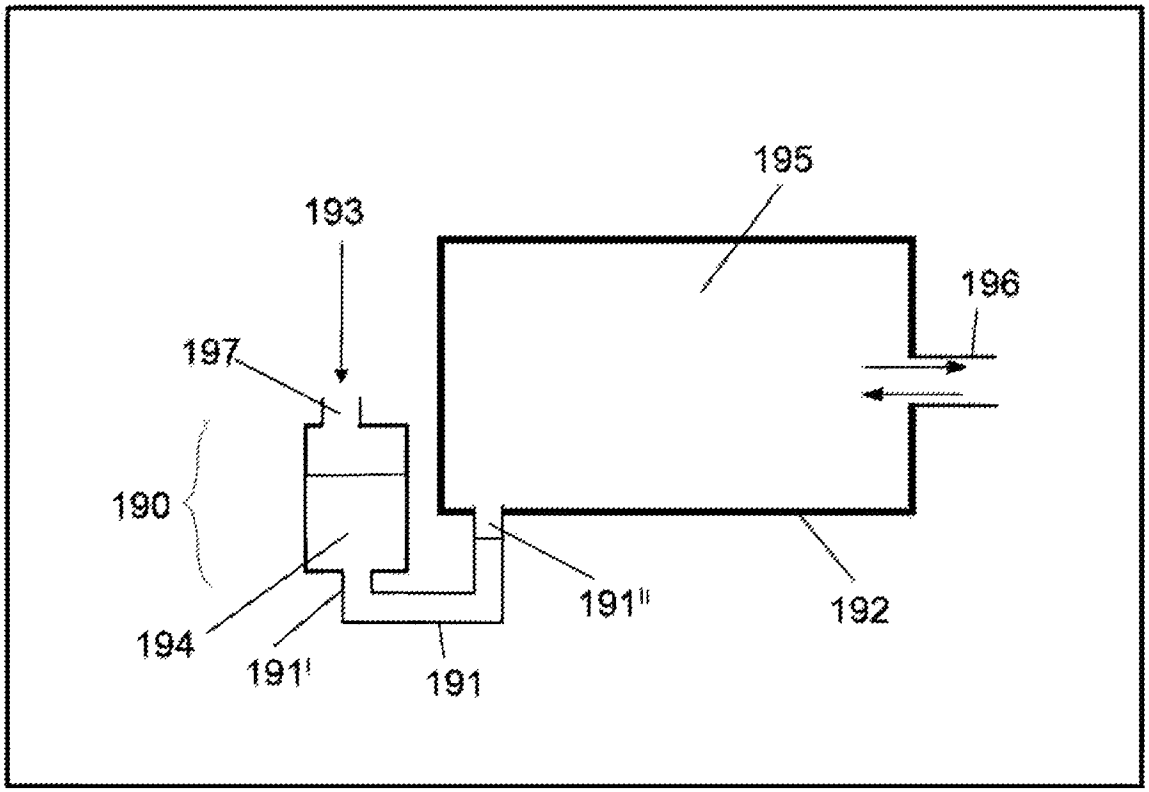

FIGS. from 8 to 14 relate to examples of embodiments of the present disclosure;

FIGS. 15A and 15B relate to a specific application of the method of the disclosure;

FIG. 16 shows a compensator according to the prior art;

FIGS. 17, 18 and 19 show three different embodiments of a compensator according to the present disclosure.

DETAILED DESCRIPTION

Definitions

In the following patent application, the term "tank" means a tank within which is preserved or stored one fluid or multiple fluids.

This fluid or these fluids, therefore, exert a hydrostatic pressure on the inner walls of the tank.

For the purposes of the present disclosure, said tank is subsea, i.e. located at a certain depth from the surface of the water, for example, of a river, of a lake, of a natural or artificial basin, of the sea.

In one aspect of the disclosure, the tank is subsea, i.e. located under the surface of the sea and, preferably, on the bottom of the sea; typically, the tank can be located at a depth between 500 and 3,000 meters.

Given the site where it is located, in addition to the hydrostatic pressure exerted by the fluid or by the fluids, the tank is subjected to the bathymetric pressure of the surrounding water.

Depending on the depth at which it is located, said pressure is between 50 and 305 bar a.

The term "working fluid" means a compound that is in liquid form in the desired operating conditions and that is employed in subsea technical operations (the so-called "technical fluids").

Hereafter, reference shall be made to the working fluid with the abbreviation "FL".

A working fluid is chosen in the group that comprises: anticorrosives, methanol, monoethylene glycol, diethylene glycol, asphaltene inhibitors, corrosion inhibitors (such as amine salts), wax inhibitors, fouling inhibitors, anti-hydrates (for example, methanol, diethylene glycol, monoethylene glycol) anti-emulsions, anti-foams, etc.

The term "bathymetric compensation fluid" means a fluid that is able to compensate the change in internal pressure due to the change, and preferably to the decrease, of the volume of said working fluid (FL), change due to emptying by even partial withdrawal of the working fluid (FL) from the tank.

The working fluid (FL) is preferably represented by a liquid.

For the purposes of the present disclosure, the bathymetric compensation fluid (hereafter abbreviated with "FC") is water, for example of a river, of a lake, of a natural or artificial basin, or seawater.

In the following description, for the sake of simplicity, reference is made to the case in which the bathymetric compensation fluid (FC) is represented by seawater.

Use of seawater as compensation fluid represents a preferred aspect of the present disclosure.

If necessary, for the uses described herein, water enters the tank after an appropriate filtering step to remove any particulate, sand, sediments.

When the bathymetric compensation fluid is seawater, unless otherwise indicated, seawater is understood to have a density of approximately 1,020-1,040 kg/m$^3$ and therefore it averages approximately 1,030 kg/m$^3$.

In a preferred aspect of the present disclosure, the working fluid (FL) and the bathymetric compensation fluid (FC) are mutually miscible.

The term "separation fluid" means a liquid that has properties that make it able to separate effectively the working fluid from the bathymetric compensation fluid.

Hereafter, reference shall be made to the separation fluid with the abbreviation "FS".

Although ideally a minimum thickness of the separation layer, i.e. of the height of the layer, would be sufficient, a certain thickness is necessary to prevent the FL from mixing with the FC, for example if the tank is subjected to stresses.

Stresses may occur while filling or emptying the tank or while transporting or positioning the tank.

Any fluid presenting determined characteristics may be used as separation fluid (FS), as discussed below.

a. Immiscibility

According to a first aspect of the disclosure, the separation fluid (FS) must be immiscible both in the working fluid (FL) and in the bathymetric compensation fluid (FC).

According to another aspect of the disclosure, the separation fluid (FS) may be immiscible either in the working fluid or in the bathymetric compensation fluid.

According to an alternative aspect of the disclosure, the separation layer consists of two separation fluids, which will be indicated as FS1 and FS2, where these two fluids are mutually immiscible.

If two separation fluids FS1 and FS2 are used, each of them will be in contact with the FL or with the FC, with which it will not be miscible, being instead miscible, respectively, with the FC or the FL with which it is not in contact.

A definitely preferable characteristic is for the separation fluid to have the least possible solubility in water and in the most common organic solvents/compounds.

The second-most important parameter is density.

b. Density

In a first aspect of the disclosure, the FS must have an intermediate density between the working fluid and the compensation fluid, i.e. dFL<dFS<dFC or dFC<dFS<dFL (where "d" indicates "density" in kg/m$^3$).

Preferably, those fluids that are characterized by a density value sufficiently distant from that of FL and FC will be chosen; for the present purposes, this difference can be at least 30 kg/m$^3$, preferably 60 kg/m$^3$.

Therefore, two density ranges can be identified:

Group I: 930-1,000 kg/m$^3$, and

Group II: 1,060-1,100 kg/m$^3$.

In a second aspect of the disclosure, which presupposes determined circumstances described below, the FS has a higher density both than the working fluid and than the bathymetric compensation fluid, i.e.: dFS>dFL and dFS>dFC.

In a second aspect of the disclosure, which presupposes determined circumstances described below, the FS has a lower density both than the working fluid and than the bathymetric compensation fluid, i.e.: dFS<dFL and dFS<dFC.

According to alternative aspects, which presuppose determined circumstances described below, the FS may have a lower density both than the working fluid and than the bathymetric compensation fluid, i.e.: dFS<dFL and dFS>dFC or it may have a density higher than the working fluid and lower than the bathymetric compensation fluid, i.e.: dFS>dFL and dFS<dFC.

c. Viscosity

The viscosity parameter is a parameter that assumes a certain importance, because more viscous fluids withstand dynamic stresses better, thus preventing mixing with FL or with FC.

In general, therefore, a fluid with higher viscosity is preferable with respect to a fluid with lower viscosity.

For the purposes of the present disclosure, as will be described below, one or more strategies may be employed to avoid mixing with FL or FC, depending on requirements:

use of additives to increase viscosity, use of filling bodies, which may be added to the working fluid (FL) and/or to the separation layer (FS) and/or to the compensation fluid (FC).

use of separators inside the tank, where such strategies may compensate or improve also other properties or aspects of the FS.

d. Surface Tension

The parameter of surface tension is a preferential requirement, if FS has affinity for the inner surfaces of the tank.

The higher the affinity (FIG. 2C), the lower may be the thickness of the separation fluid (always within a range of thickness values that depend on other factors, as described above).

For the purposes of the present disclosure, the separation fluid may have no affinity, where it is preferable for it to be neutral or to have affinity for the inner surface of the tank.

Figure 1:
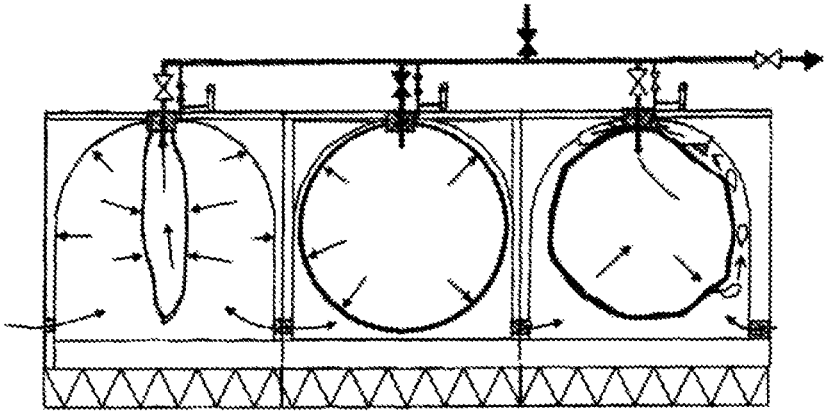
FIG. 1 PRIOR ART
FIG. 1 shows the diagram of a subsea tank according to the prior art U.S. Pat. No. 7,448,404.
Figure 2:
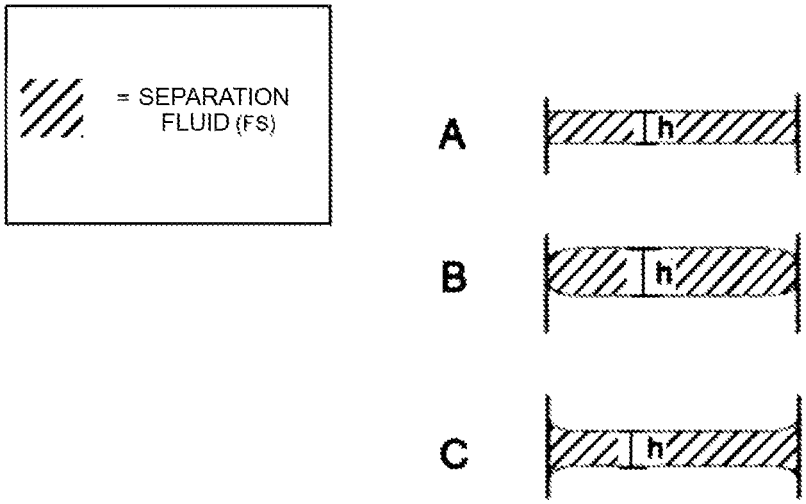
FIGS. 2A, 2B and 2C show a separator layer according to the present disclosure in three different configurations.

FIG. 2 shows the behavior of a neutral fluid (A), without affinity (B) and with affinity (C) to the inner walls of the tank.

In case B, it is necessary to provide a thicker layer of the FS than in case A (for equal other conditions).

To increase affinity, it is possible to proceed with one or more strategies, such as:

addition of appropriate surfactants to the separation fluid, superficial treatment of the inner walls of the tank.

e. Liquid State

As described above, the separation layer, represented by one (FS) or by two separation fluids (FS1,FS2) must be liquid in the operating conditions.

f. Toxicity

The separation fluid must not be toxic for operators.

In general, and independently of the above, for the purposes of the present disclosure, the following may be used:

chlorinated and/or fluorinated organic compounds: chloroalkanes and/or fluoroalkanes; chloroparaffins characterized by a chlorine content between 20% and 40%;

silicon compounds, including also chlorosilanes and/or fluorosilanes.

Mixtures comprising one or more of the compounds listed above are equally possible.

Some examples of mixtures comprise:

| Mixture | Components | Density (Kg/m$^3$) |
|---|---|---|
| 1 | chlorofluoropentane, chlorofluorohexane, chlorofluoroheptane | 970 |
| 2 | trifluoropentane, trifluorohexane, trifluoroheptane, | 975 |
| 3 | Chloroparaffin (35% Cl) | 1,075 |
| 4 | Difluoro-trifluorobutane, and/or trifluorohexane and/or trifluoroheptane | 990 |
| 5 | Chloroparaffin (30-35% Cl) | 1,060 |
| 6 | Trifluorooctane, trifluoroheptane | 990 |
| 7 | Perfluorooctane/chloro-fluoro-paraffin | >1,300 |
| 8 | Trifluorobutane, trifluoropentane, trifluorohexane | 990 |
| 9 | Fluoropentane, fluorohexane, fluoroheptane, fluorohexane | 950 |
| 10 | Chloroparaffin (30% Cl) (e.g. Cloroparin 30) | 970 |
| 11 | Mixture of chloroparaffins (38% Cl) | 1,080 |

The disclosure provides a method for compensating bathymetric pressure inside a subsea tank is described.

Said compensation of the bathymetric pressure becomes necessary in the moment when a part of the working fluid FL is withdrawn for the use for which it is intended.

In particular, bathymetric compensation is obtained by the entry of an equivalent volume of a bathymetric compensation fluid FC, which in a first embodiment of the present disclosure enters inside the same tank from which the working fluid is withdrawn (FL).

The separation between the working fluid FL and the bathymetric compensation fluid FC is obtained, and maintained, by virtue of a separation layer that is represented by a fluid and, preferably, by a liquid.

For the purposes of the present disclosure, said separation fluid FS is not miscible either in said working fluid FL or in said bathymetric compensation fluid FC.

Figure 3:
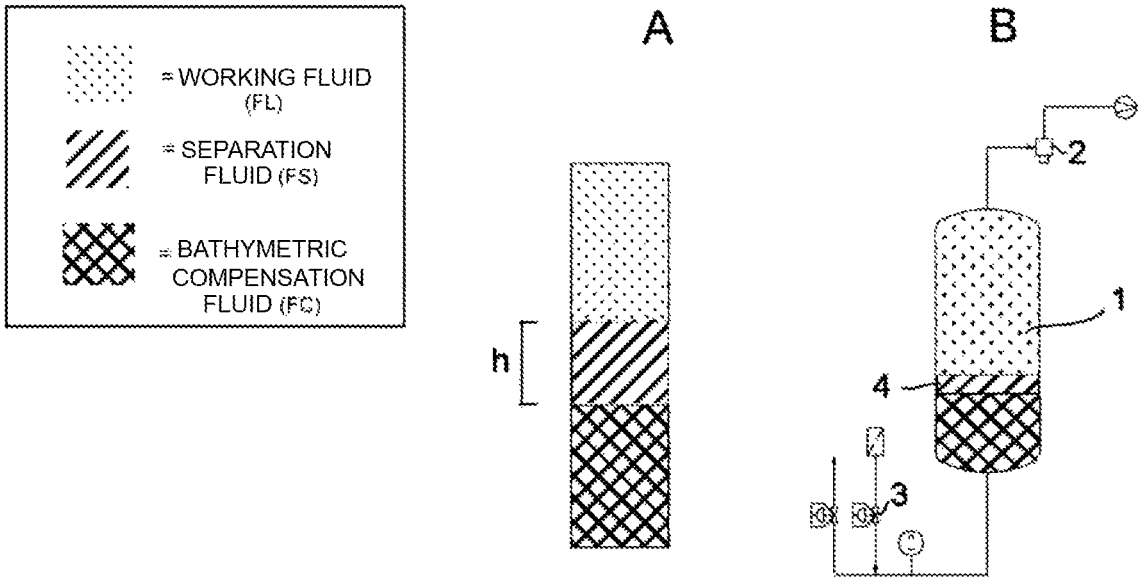
FIGS. 3A and 3B relate to a first aspect of the disclosure.
Figure 4:
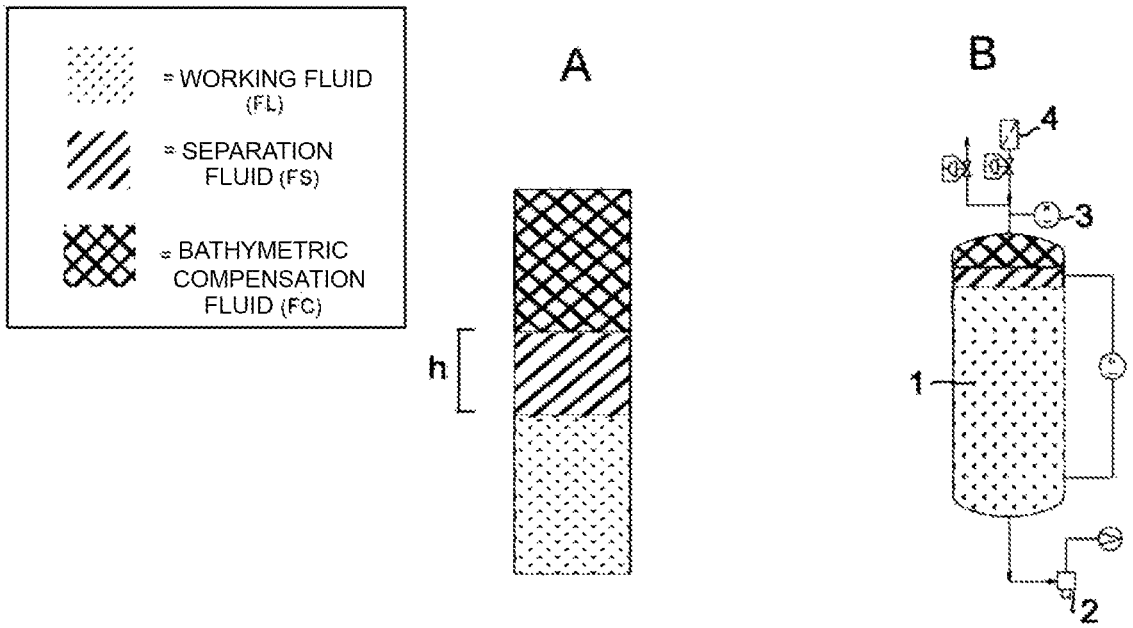
FIGS. 4A and 4B relate to a second aspect of the disclosure.

In particular, the method comprises a step of withdrawing the working fluid FL, which is preferably obtained by means of appropriate pumps (2 in FIGS. 3B and 4B, 402 in FIG. 15A, 502 in FIG. 15B).

Figure 13:
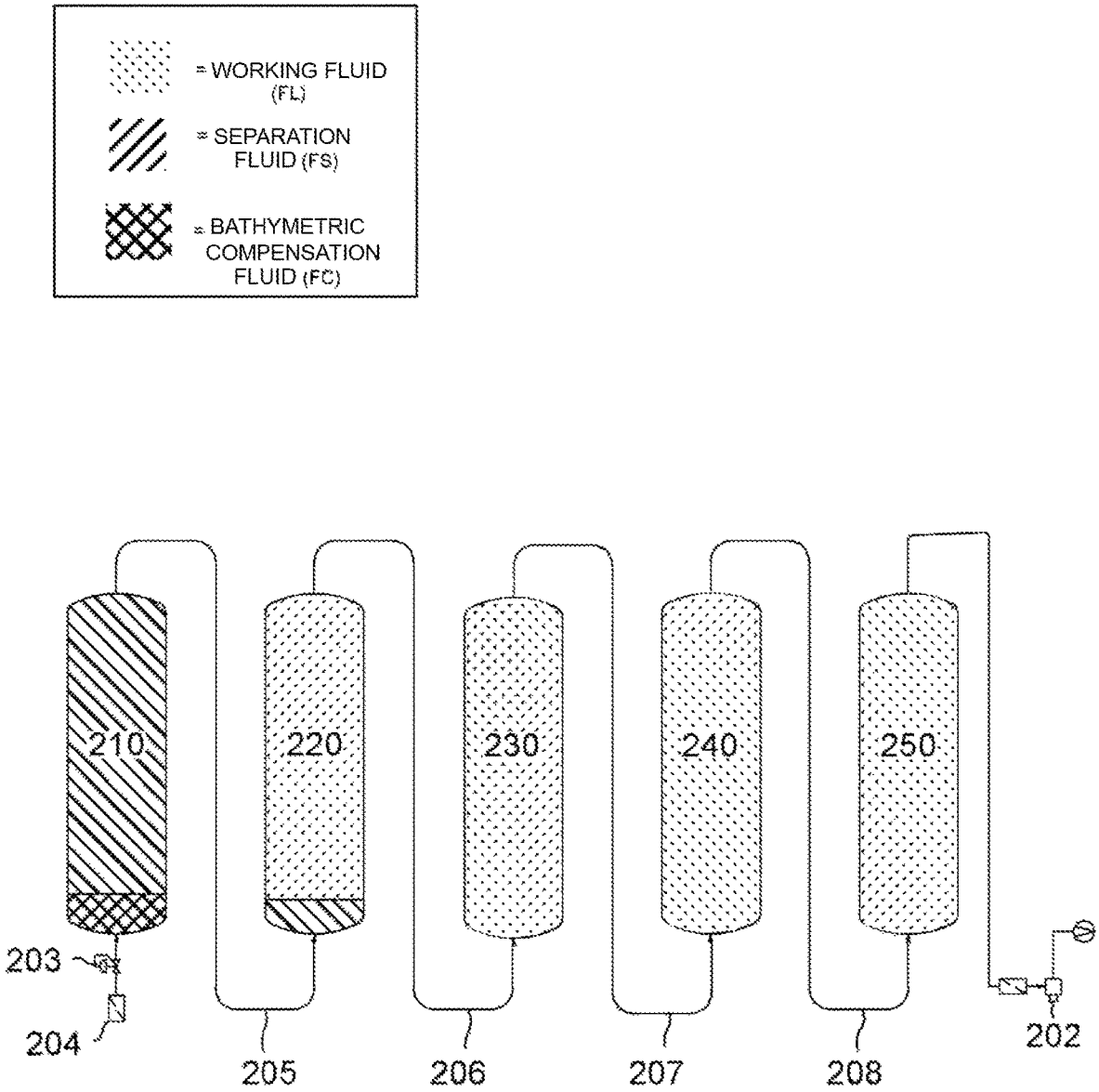
Figure 14:
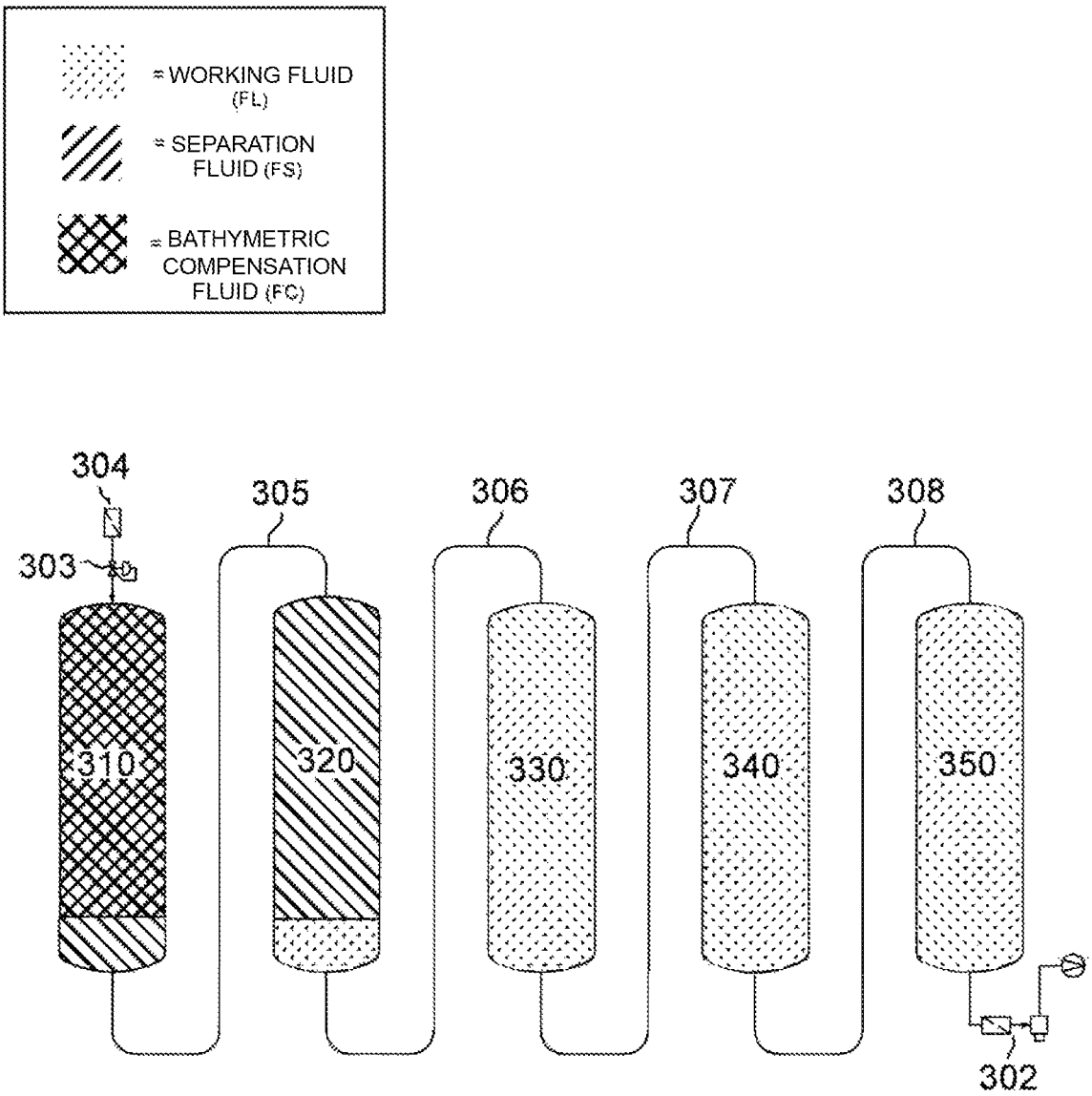

The step of entry of the compensation fluid FC, which is preferably concurrent with the step of withdrawing the working fluid (FL), is obtained by means of appropriate control valves (3 in FIGS. 3B and 4B, 203 in FIG. 13, 303 in FIG. 14, 403 in FIG. 15A, 503 in FIG. 15B).

Before entering inside tank 1, the compensation fluid FC may be filtered in a dedicated filter (4 in FIGS. 3B and 4B, 204 in FIG. 13, 304 in FIG. 14, 404 in FIG. 15A, 504 in FIG. 15B), for the removal of particulate material and sediments.

According to a first aspect of the disclosure represented for example in FIG. 3A, the working fluid FL has a lower density than that of the bathymetric compensation fluid FC; therefore, the withdrawal of the working fluid FL will take place from above (from the head of) tank 1 and the seawater will enter from below.

In a second aspect of the disclosure, for example shown in FIG. 4A, the working fluid FL has a higher density than that of the bathymetric compensation fluid FC; therefore, the withdrawal of the working fluid FL will take place from below (from the bottom of) tank 1 and the seawater will enter from above.

According to the first embodiment of the disclosure, the separation fluid FS is in contact both with the working fluid FL and with the bathymetric compensation fluid FC, and the three fluids FL,FS,FC are inside a single tank 1.

In accordance with an aspect that can be applied to all the embodiments and aspects of the present disclosure, the density of seawater can be modified according to specific needs; for example, if the difference in density between the working fluid FL and the compensation fluid FC does not allow a net separation between the fluids.

For example, it may be increased, preferably up to 1,050 $kg/m^3$ and more preferably up to 1,100 $kg/m^3$.

For this purpose, the compensation fluid FC that is pumped inside tank 1 comes into contact with an appropriate additive, thus increasing its density.

An appropriate additive that can be used for this purpose can be a salt, for example selected in the group that comprises: sodium chloride or sodium formate, potassium chloride (in the case of a compensation fluid represented by seawater).

Said salt or mix of salts may be in solid form and it may be immersed in a saturated solution.

Contrary to the above, if necessary, the density of the compensation fluid FC can be decreased, also by adding an appropriate additive.

For this purpose, an alcohol may be added, selected between methanol and ethanol (in the case of a compensation fluid represented by seawater).

The quantity of alcohol, for example of methanol, that is added may be between 10% and 40%, preferably between 20% and 30% or even 35% (vol/vol).

The density of seawater can thus be decreased to 1,000 $kg/m^3$ (for example, by the addition of 20% methanol) and more preferably to 970 $kg/m^3$ (for example, by the addition of 35% methanol).

In a second embodiment of the disclosure, the separation layer in fluid form is represented by two fluids, respectively FS1 and FS2, immiscible with each other.

Figure 5:
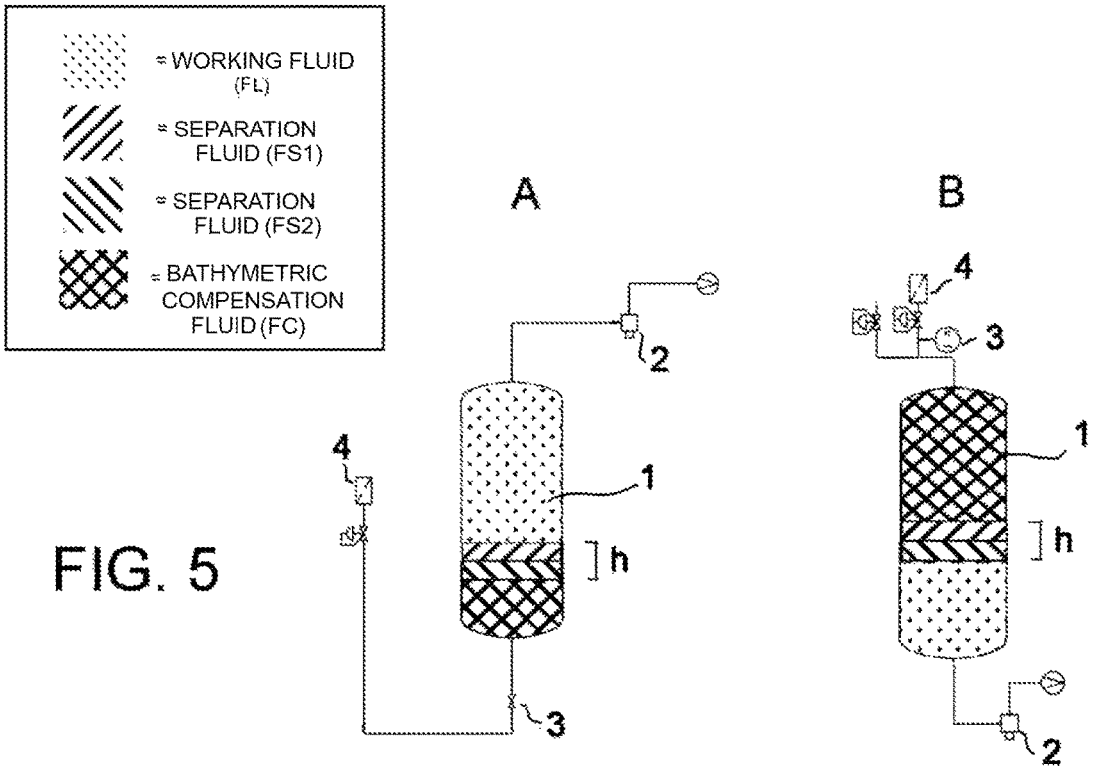
FIGS. 5A and 5B relate to an alternative aspect of the disclosure.

As represented for example in FIG. 5, the two fluids FS1 and FS2 are stratified on each other by virtue of the difference in density (dFS1≠dFS2).

For convenience, in the remainder reference shall be made to FS1 as to the fluid having the lower density.

Each of the two fluids is also immiscible with the working fluid FL or with the compensation fluid FC, with which it is in contact.

For the purposes of the present disclosure, therefore, the circumstance represented in FIG. 5A can occur, in which:

$$dFS1,dFS2>dFL$$

$$dFC>dFS1,dFS2.$$

Alternatively, the circumstance represented in FIG. 5B can occur, in which:

$$dFS1,dFS2<dFL$$

$$dFC<dFS1,dFS2.$$

For the purposes of the present disclosure, the use of two separation fluids may become necessary in the presence of a working fluid FL characterized by a high solvent power, such as an aromatic compound that is very poorly soluble in water.

For example, this is the case in which xylene is used, or another aromatic solvent contained in wax inhibitors, asphaltene inhibitors, some biocides, some antifoam agents.

For the purposes of the present patent application, the separation layer, consisting of a single fluid FS or two separation fluids FS1 and FS2, must have a sufficient thickness ("h" in FIGS. 2,3,4 and 5) to ensure the separation between FL and FC.

Said separation must be maintained even if the tank is subjected to stresses.

Thickness h depends on some factors, such as:

- as described above, the possibility that the tank may be subjected to stresses,
- as described above, the surface tension and, hence, the affinity for the inner surface of the tank,
- the dimensions of the tank and, in particular, its inner diameter (D).

According to a preferred aspect of the disclosure, height h of the separation layer (SS) is approximately 0.5*D (D=inner diameter of the tank), if it is expected that the tank may be subjected to stresses.

In case of purely static installations, i.e. when minimal flow rates of working fluid and minimal oscillations of the tank are expected, values down to 0.2*D, or even lower, are nonetheless possible.

According to the embodiment of the disclosure, height h is the thickness of the separation fluid (FS) or the total thickness of the first (FS1) and of the second (FS2) separation layers.

According to an additional embodiment of the disclosure, the separation fluid (FS) has higher density both than the working fluid (FL) and than the bathymetric compensation fluid (FC).

In this case, it is still possible to use such a working fluid (FL) operating an indirect bathymetric compensation by the compensation fluid (FC) on tank 1 that contains the working fluid (FL).

Figure 6:
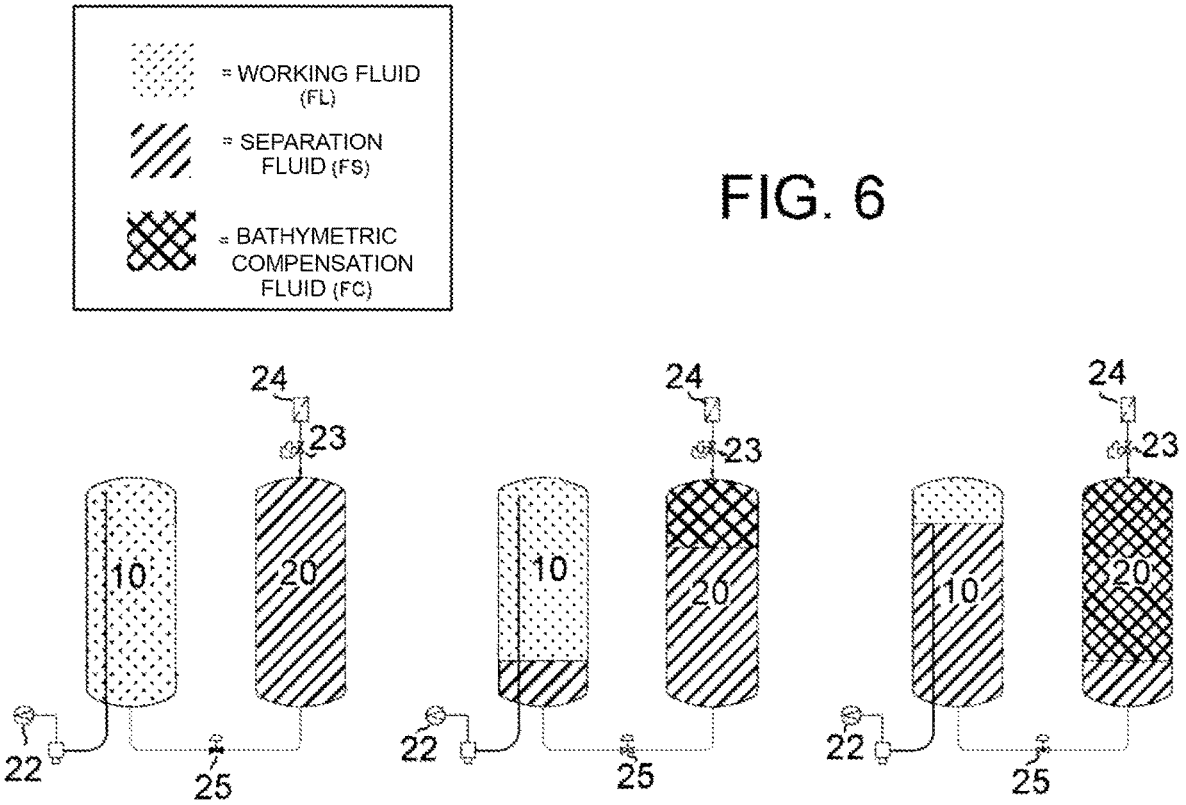
FIG. 6 shows a second embodiment of the method of the disclosure.

As shown in FIG. 6, the working fluid (FL) withdrawn from a first tank 10 by means of a pump 22 is compensated by an equivalent volume of separation fluid (FS), which is transferred into the same tank 10 through an appropriate valve/line 25, which ensures fluid communication between the two tanks 10,20.

The separation fluid (FS), in turn, is withdrawn from a second tank 20, in fluid connection with the first tank 10, into which enters an equivalent volume of the compensation fluid (FC), through an opposite valve/line 23 and after possible filtration by means of filter 24.

The compensation fluid (FC), therefore, does not enter into the same tank 10 that contains the working fluid (FL).

For the purposes of the present disclosure, use of a separation fluid (FS) which is not concurrently in contact in the same tank with the working fluid (FL) and with the compensation fluid (FC), finds application in the case of working fluid (FL) represented by chemical products containing solvents that are difficult to manage with chloroparaffins or fluoroalkanes, which are preferably characterized for a density in the range of 900-1,100 $kg/m^3$.

The separation fluid (FS) is to be sought among perfluoroalkanes that have a density close to 1,800 $kg/m^3$.

The bathymetric compensation method according to this embodiment of the present disclosure, therefore, comprises the use of a system of a plurality of tanks 10,20; 70,80; 210,220,230,240,250; 310,320,330,340,350 mutually connected in series.

Figure 12:
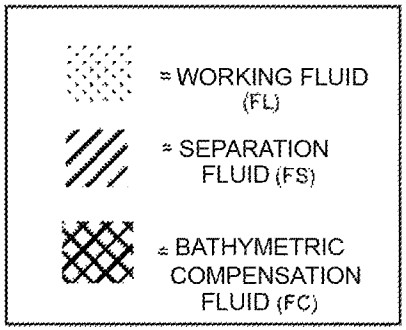
Figure 12:
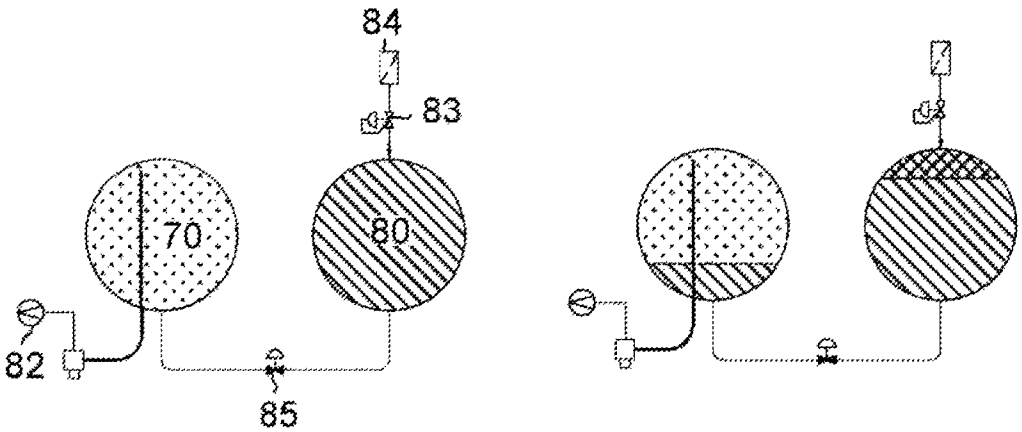

According to a first aspects represented in FIGS. 6 and 12, the method comprises the use of a separation fluid (FS) having higher density both than the working fluid (FL) and than the compensation fluid (FC): dFS>dFL,dFC.

In particular, it is possible to use two tanks 10,20; 70,80 mutually connected in series according to bottom-bottom connection modes.

For the purposes of the present disclosure, when the separation fluid (FS) does not have intermediate density between the working fluid (FL) and the bathymetric compensation fluid (FC), then the method comprises the use of a system of at least two tanks and is carried out in such a way that the working fluid (FL), the bathymetric separation fluid (FC) and the bathymetric compensation fluid (FC) are never present inside one of the tanks of the system.

Such a configuration can advantageously be used if the difference in density between the working fluid (FL) and the bathymetric separation fluid (FC) is approximately <50 $kg/m^3$ and preferably approximately <35 $kg/m^3$.

The configuration in which the separation fluid (FS) has lower density both than the working fluid (FL) and than the bathymetric compensation fluid (FC) is equally possible and requires a head-head connection between two tanks.

According to another aspect represented in FIG. 13, the method comprises the use of a separation fluid (FS) having lower density than the compensation fluid (FL) and higher density than the working fluid (FC): dFS<dFC and dFS>dFL.

For this purpose, it is possible to use two tanks 210,220 or a plurality of tanks 210,220,230,240,250 mutually connected in series in head-bottom mode.

According to another aspect represented in FIG. 14, the method comprises the use of a separation fluid (FS) having higher density than the compensation fluid (FL) and lower density than the working fluid (FC): dFS>dFC and dFS<dFL.

For this purpose, it is possible to use two tanks 310,320 or a plurality of tanks 310,320,330,340,350 mutually connected in series in head-bottom mode.

The disclosure provides a tank 1 for storing a working fluid (FL) in accordance with the above description is described.

In one aspect of the disclosure, said tank can be used in the method of the disclosure, according to each of the embodiments described above.

In particular, each of the tanks 1,10,20,30,50,70,80,210,310,400,500 is a subsea tank, preferably to be positioned on the bottom of the sea.

For the purposes of the present disclosure, it can be made of plastic or metal, with appropriate thickness.

In a preferred aspect, the vertical tank has cylindrical shape, in a still more preferred aspect it is characterized by a height/inner diameter ratio 7.

Figure 7:
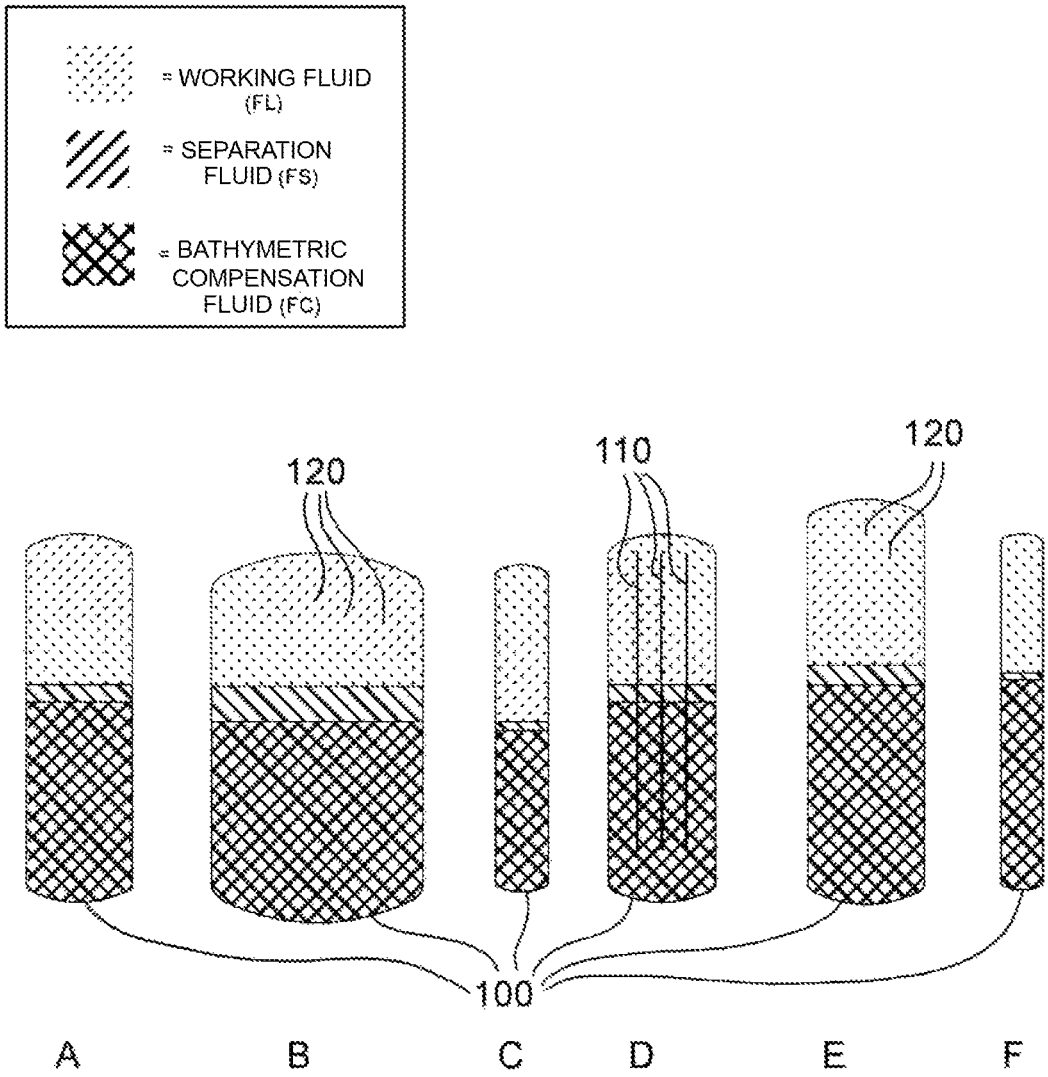
FIG. 7 schematically shows some configurations of the tank described by the present disclosure.
Figure 11:
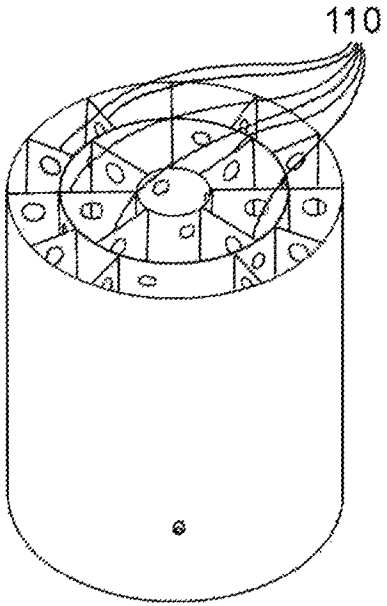

A lower ratio is equally possible by virtue of the use of appropriate separator walls (110 in FIGS. 7 and 11).

Separator walls 110 are understood to be holed plates, made of plastic or metallic material, positioned vertically inside the tank, possibly radially, which separate the inner volume into equal portions (segments).

The walls 110 must be holed to ensure communication between the various sectors.

Indicatively, the maximum distance between them must preferably be approximately 0.5 m.

An example of an embodiment of the separator walls according to the disclosure is represented in the tank of FIG. 11.

According to an aspect of the present disclosure, the tank (100 in FIG. 7) can be filled with filling bodies 120 to reduce the problems relating to oscillatory phenomena and consequent mixing between working fluid (FL) and compensation fluid (FC).

This strategy can be as an alternative or in addition to the use of the separation walls 110 and/or to the change in the density of the compensation fluid (FC).

For the purposes of the present disclosure, these filling bodies 120 are made of an appropriate inert, plastic or metallic material, with higher density than that of the fluids FL, FS, FC.

For example, 6÷8 inch ((15,24÷20,32) PALL rings made of PVC or stainless steel can be used.

The use of the filling bodies 120 can advantageously contribute to reduce height h of the separation fluid FS, compared to the situation in which said bodies are not used.

According to an aspect of the present disclosure, height h of the separation fluid FS is preferably 1.5÷2 times the larger dimension of the filling bodies used (which, for example, can have dimensions of 8"=203 mm).

To implement the method of the disclosure, inside tank 1 there are loaded the working fluid (FL) and the fluid or the fluids of the separation layer FS,FS1,FS2, with an appropriate feeding order in the case of FS1 and FS2; the fluids FS,FS1,FS2 are positioned inside tank 1 according to their respective densities.

The tank may contain inert gas, introduced before use for the storage of a working fluid (FL); during the withdrawal/pumping steps it is preferable for the quantity of said inert gas to be minimized, inasmuch as its volume will be replaced by the bathymetric compensation fluid FC.

The withdrawal of the working fluid FL and the concurrent entry of the compensation fluid FC are preferably carried out using non-return or PCV valves appropriately dimensioned and positioned to prevent flow-back or recirculation, which could lead to a mixing of the fluids or break the separation barrier constituted by the separation fluid FS.

As represented in FIGS. 15A and 15B, a description is provided of the application of the method of the present disclosure during transportation, positioning and through to the operation of a tank 400,500 on the sea bottom.

In particular, tank 400,500 can contain a working fluid FL and a separation fluid FS, having lower density (FIG. 15A) or higher density (FIG. 15B) than the bathymetric compensation fluid FC.

In both cases, into tank 400,500 it is possible to inject a volume of nitrogen, to inert the system and avoid flammability problems; nitrogen will be positioned above the working fluid and the separation fluid.

Once the tank is positioned, the nitrogen is purged with concurrent entry of the compensation fluid FC to compensate bathymetric pressure.

Compensation is continued throughout the withdrawal of working fluid FL.

It should be noted that, during transport, tank 400,500 can be maintained horizontal.

The present disclosure then also describes a subsea tank or a system of subsea tanks in fluid communication with each other, which are filled with: a separation fluid (FS) or a first separation fluid (FS1) and a second separation fluid (FS2), and a working fluid (FL) and/or a compensation fluid (FC), where the tank and said separation fluid (FS,FS1,FS2), compensation fluid (FC) and working fluid (FL) have one or more of the characteristics described above.

Once in use, inside the tank of the disclosure, the quantity of the working fluid (FL) decreases and the quantity of the bathymetric compensation fluid (FC) increases.

In accordance with an additional embodiment, the method of the present disclosure is described for application to so-called subsea compensators.

For the execution of some subsea technical activities, typically represented by the movement of hydraulic oil mechanisms, for example for the actuation of hydraulic pistons, the necessary technical fluids are withdrawn and reinjected in dedicated service tanks.

Another example is that of dielectric fluids, for filling canisters containing electric material, which can be subject to contraction or expansion of their volume because of ambient temperature or in relation to the on/off cycle of the electrical components.

For this purpose, compensators are provided, which balance the bathymetric pressure that acts on the service tank by means of the entry of seawater.

For this purpose, the method of the present disclosure is implemented in a tank represented by a compensator.

As represented for example in FIG. 16, a traditional compensator 160 (represented by a tank) is in fluid connection with a service tank 162 containing a working fluid 165 through an appropriate connection 161, which comprises an inlet/outlet portion of compensator 161' and an inlet/outlet portion of tank 161".

Into compensator 160 enters seawater 163 in response to the withdrawal of working fluid 165 from the service tank 162 carried out by means of a withdrawal point 166.

Into compensator 160 enters seawater 163 in response to the contraction (expansion) of the volume of working fluid 165 contained in the service tank 162 carried out for example because of a decrease (increase) of the temperature of the working fluid 165.

Inside compensator 160, seawater 163 and the working fluid 165 are maintained separate by virtue of a separation element 164 represented by a membrane or by a flexible/deformable container.

The withdrawal and the reinjection of the working fluid determines a change in bathymetric pressure which acts on the service tank 162, which is compensated by the entry or by the exit of seawater 163 and, consequently, by the downward or upward movement, respectively, of the separation element 164.

The use of these systems, however, entails the same drawbacks mentioned above for storage systems.

The method of the present disclosure can then be applied according to a first embodiment represented in FIG. 17.

In particular, this configuration is applied for a separation fluid (FS) whose density is higher than seawater and lower than the density of the working fluid (FL):

$$dH_2O<dFS<dFL.$$

Therefore, the decrease of the bathymetric pressure that acts on a service tank 172 due to the withdrawal of the working fluid 175 through a withdrawal point 176 is compensated by the entry of seawater 173 into compensator 170 (or first tank), with which the service tank 172 is in fluid connection through conduit 171 having an inlet/outlet portion of compensator 171' and an inlet/outlet portion of the second tank 171"; the mixing of seawater 173 with the working fluid 175 is prevented by virtue of the separation fluid 174.

In a preferred aspect of the disclosure, in this conformation, compensator 170 has the inlet of seawater 177 in the upper part and it is located above the service tank 172 through an inlet/outlet portion of tank 171" in the upper part of the service tank 172.

The method of the present disclosure can also be applied according to a second embodiment represented in FIG. 18.

In particular, this configuration is applied for a separation fluid (FS) whose density is lower than seawater and higher than the density of the working fluid (FL):

$$dH_2O>dFS>dFL.$$

Therefore, the decrease of the bathymetric pressure that acts on a service tank 182 due to the withdrawal of the working fluid 185 through a withdrawal point 186 is compensated by the entry of seawater 183 into compensator 180 (or first tank), with which the service tank 182 is in fluid connection through conduit 181 having an inlet/outlet portion 181' and an inlet/outlet portion of the service tank 181"; the mixing of seawater 183 with the working fluid 185 is prevented by virtue of the separation fluid 184.

In a preferred aspect of the disclosure, in this conformation, compensator 180 has the inlet of seawater 187 in the lower part and the inlet/outlet portion of compensator 181" in the opposite part, in fluid connection with the inlet/outlet portion of tank 181" in the upper part of the service tank 182.

The method of the present disclosure can also be applied in an additional embodiment represented in FIG. 19.

In particular, this configuration is applied for a separation fluid (FS) whose density is higher than seawater and higher than the density of the working fluid:

$$dH_2O>dFS \text{ and } dFS>dFL.$$

Therefore, the decrease of the bathymetric pressure that acts on a service tank 192 due to the withdrawal of the working fluid 195 through a withdrawal point 196 is compensated by the entry of seawater 193 into compensator 190 (or first tank), with which the service tank 192 is in fluid connection through conduit 191 having an inlet/outlet portion of compensator 191' and an inlet/outlet portion of tank 191"; the mixing of seawater 193 with the working fluid 195 is prevented by virtue of the separation fluid 194.

In a preferred aspect of the disclosure, in this conformation, compensator 190 has the inlet of seawater 197 in the upper part and it is located below the service tank 192 through an inlet/outlet portion of tank 191" in the lower part of the service tank 192.

This embodiment can find similar application for a separation fluid whose density is lower than both seawater and than the separation fluid (FS).

Therefore, in light of the above description, the method of the present disclosure also finds application for a subsea tank 1, which may be single or in a system of a plurality of subsea tanks 10,20,30,50,70,80,210,310,400,500, which is in fluid connection with a service tank 172,182,192 which contains the working fluid (FL) and from which said working fluid (FL) is withdrawn to be reinjected into tank 1 or is withdrawn to be reinjected into the service tank 172,182,192.

For the purposes of the present disclosure, the service tank 172,182,192 can be represented by a canister containing electric material.

The disclosure and some particular embodiments thereof will now be described in closer detail in the non-limiting Examples that follow.

Example 1

Case in which dFL<dFC

A rigid, metallic tank is filled with an (anticorrosive) chemical product (FL) with density of approximately 950 $kg/m^3$. Into the same tank a certain volume of an organic compound (FS) is made to flow, constituted by a mixture of chloro fluoro alkanes which will be positioned below the chemical compound loaded previously, having a density of approximately 985 kg/m$^3$ and the two fluids being mutually insoluble. The tank, always held horizontal, will then be positioned vertically to increase the height of the separation layer for equal volume. The volume layer of the compound used for separation (FS) will be sufficiently high to prevent any mixing in the case of unwanted accelerations. The tank is then positioned on the sea bottom. Seawater (FC) enters into the tank to compensate external pressure, forming a third liquid layer. The pumping system will start to aspirate the chemical product from the head of the tank generating a vacuum that will be filled by other seawater that will enter from the bottom of the tank through appropriate non-return valves. A level meter of the differential pressure type will indicate the residual chemical product. When the level of the chemical product will reach a minimum value, the tank will be recovered and replaced with a full tank, or filled in place.

Example 2 dFL<dFC

A plastic tank, positioned horizontally, with a length of 9 meters and diameter of 2.1 meters is filled with methanol (FL) (density 792 kg/m$^3$). Approximately 3.5 m$^3$ of fluorinated organic compound (FS) are added with density of approximately 975 kg/m$^3$ (mixture of trifluoroheptane, trifluorohexane, trifluoropentane). The tank is positioned vertically and placed on the sea bottom. Seawater (FC) will enter as the methanol is pumped and will be positioned on the bottom of the tank, compensating the external pressure. The flow rate of seawater entering the tank will be measured by a volumetric flow rate meter, which will then indicate the quantity of chemical product pumped.

Example 3 dFL>dFC

A vertical tank with a length of 12 m and diameter of 1.5 m is loaded with diethylene glycol (FL) (density 1,110 kg/m$^3$) totally soluble in water. Into the tank there are loaded approximately 1.3 m$^3$ of an organic compound corresponding to a chloroparaffin (FS) having a density of 1.075 kg/m$^3$ (30÷35% of chlorine). The height of the intermediate layer was calculated to be approximately 0.75 m. The tank is positioned vertically and placed on the sea bottom. Seawater (FC) will enter and it will be positioned above the two preceding products forming a third layer. Diethylene glycol will be pumped in the pipeline, where its presence is required leaving a vacuum that will be filled by seawater, which will enter from above through a valve, calibrated to open at a certain pressure difference (0.5 barg). The flow rate of glycol pumped will be measured by means of the flow rate of seawater flowing in.

Example 4

Use of a Separator Layer Comprising Two Separator Fluids dFL<dFC dFS1,dFS2<dFC A vertical metallic tank with elliptical heads with a length of 11 m and diameter of 1.8 m, with holed vertical walls inside it, which allow communication between the various sectors. The maximum distance between the walls is 0.5 m. The tank is loaded with a compound against the deposition of chemical compounds called asphaltenes (asphaltene inhibitor) (FL). This compound being a xylene-based solvent product (C8H10), also solubilizes many fluorochlorinated organic compounds, but it is poorly soluble in water.

Into the tank are pumped 23 m$^3$ of solvent solution with a density of 885 kg/m$^3$. On the bottom of the tank are pumped 2 m$^3$ of a non-saline aqueous solution containing an alcohol (FS1) (e.g.: ethanol), so the density of the solution is 940 kg/m$^3$. Then, 2 m$^3$ of solution of the fluorinated compound with a density of 990 kg/m$^3$ (FS2) are pumped on the bottom of the tank (an appropriate mixture of difluorotrifluorobutane, trifluorohexane, trifluoroheptane and trifluorooctane). The tank will then be placed on the sea bottom and seawater (FC) forms a fourth layer on the bottom of the tank. Although the four compounds are miscible two by two, they will form 4 distinct liquid layers.

Example 5

Change in the Density of the Compensation Fluid

Figure 8:
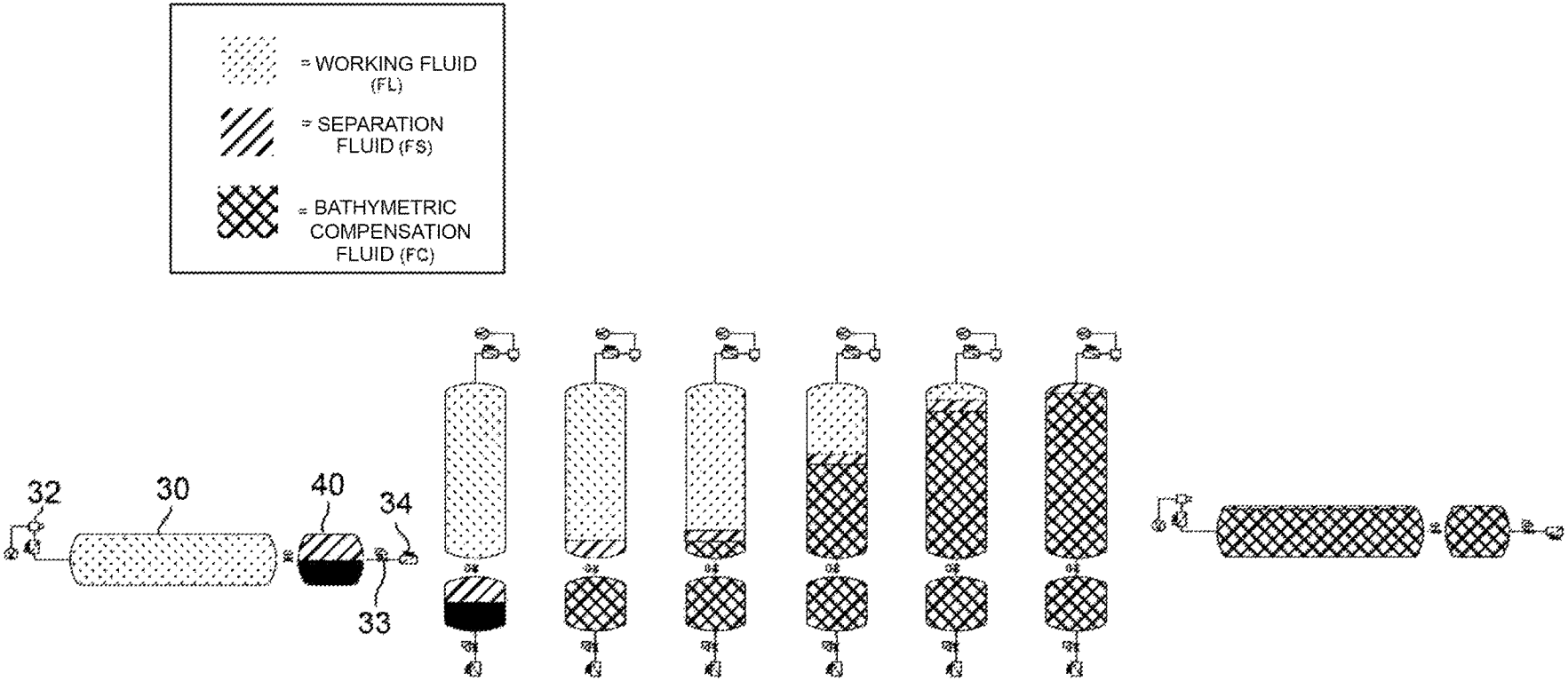

As shown in FIG. 8, in a subsea system for the injection of chemical products there is installed a plastic tank 30 with a length of 10 m and diameter of 2 m. Into this tank 30 there is loaded a chemical compound (FL) with a density of 1,010 kg/m$^3$, consisting of an aqueous solution containing amine salts, whose purpose is to reduce the speed of corrosion of the pipes. Into the coupled tank 40 of the volume of approximately 4 m$^3$ are then loaded approximately 3,000 kg of NaCl and approximately 500 liters of saturated water in NaCl (density 1,205 kg/m$^3$) (FC). Approximately 2 m$^3$ of chlorinated organic compound with density 1060 kg/m$^3$ (FS) are then loaded (the compound consists of a medium chain chloroparaffin containing 30÷35% of chlorine, insoluble both with the liquid loaded before and with seawater). The tank is positioned vertically and placed on the sea bottom. The system will then start pumping the chemical through the pump 32. Seawater will enter into the tank from the bottom through the valve 33, possibly after filtering by means of appropriate filter 34, dissolving the salt. When the tank 30 will have emptied the chemical product, approximately 30 m$^3$ of seawater will have entered. The final density of water will be approximately 1,100 kg/m$^3$ with a concentration of NaCl of approximately 10%.

Example 6

Figure 9:
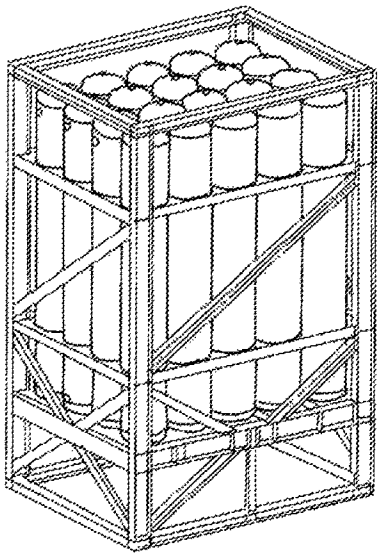

A series of metallic tanks as shown for example in FIG. 9, with a length of 7 m and diameter of 0.7 m, are positioned in parallel and connected in parallel, or communicating with each other at the head and on the bottom. The tanks are filled with a chemical compound with a density of 930 kg/m$^3$ (FL). A chemical compound of the family of fluorinated alkanes (for example trifluorooctane, trifluoroheptane) with a density of 990 kg/m$^3$ (FS) is then loaded to have an interposition layer with a height of 0.4 m. The system of tanks is then immersed in the sea and deposited on the bottom. Seawater enters from the bottom of the tanks filling them homogeneously in parallel.

Example 7

Use of Two Tanks

As shown in FIG. 12, two metallic tanks 70,80 with a volume of 20 m$^3$ each positioned in parallel are connected in series at the bottom by means of an appropriate valve 85. The first tank 70 contains a generic chemical product (FL) with density higher than 600 kg/m$^3$ and lower than 1300 kg/m$^3$ (e.g.: methanol, diethylene glycol, wax inhibitor, "antiscalant" etc.) which must be injected by means of an appropriate pump 82. The second tank 80 contains a chloro/fluorinated chemical product, for example perfluoro-octane or a chloroparaffin, with density higher than 1300 kg/m$^3$ (perfluorooctane has a density of 1,766 kg/m$^3$) (FS) insoluble in the chemical product contained in the first tank and insoluble in seawater. After being positioned on the bottom of the sea, the tanks 70,80 are connected. The pump 82 starts pumping the chemical product "depressurizing" the tanks. From the head of the second tank 80 enters seawater (FC) compensating depressurization through the valve 83 and possibly after filtration by the filter 84. The first tank is emptied of chemical product and is filled with fluorinated compound, which will remain low being insoluble in the chemical product and having higher density; the second tank will be filled with seawater that will remain on the upper part of the second tank having a lower density than the fluorinated compound and being mutually insoluble.

Example 8

Use of 2 Separation Fluids in Three Tanks

Figure 10:
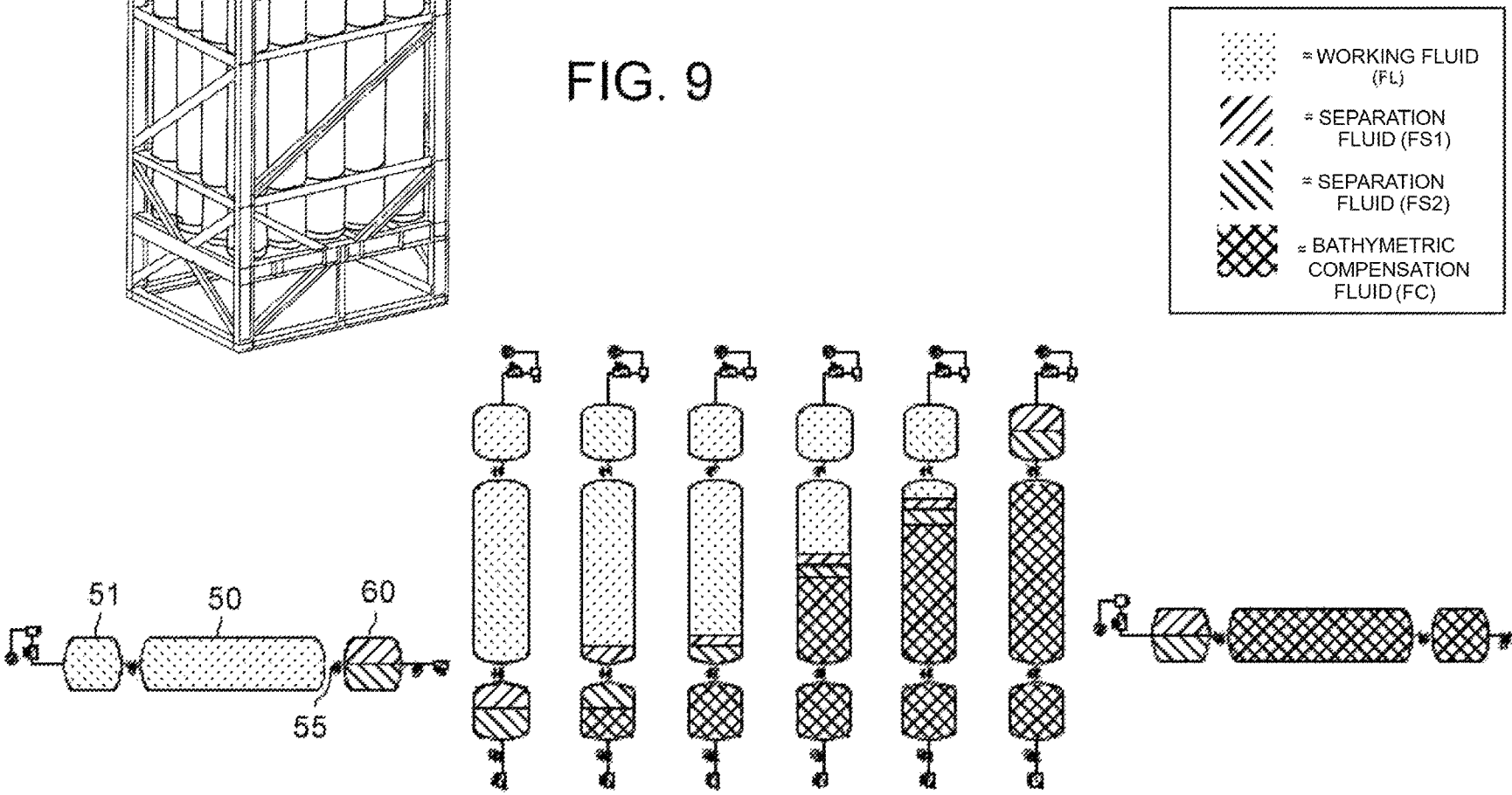

In a system for the injection of chemical products consisting of three metallic tanks 60,50,51 positioned vertically above each other (shown for example in FIG. 10) the central tank 50 and the upper tank 51 are filled with the chemical to be injected consisting of a xylene-based wax inhibitor (FL) with a density of 890 kg/m$^3$ (approximately 30 m$^3$), the one located inferiorly 60, with a volume of approximately 4 m$^3$, contains 2 m$^3$ of alcohol solution (FS1) with a density of 940 kg/m$^3$ and, moreover, it contains 2 m$^3$ of a fluorinated alkane (FS2) whose density is approximately 990 kg/m$^3$ (for example, a mixture of trifluorobutane, trifluoropentane and trifluorohexane). The system is transported horizontally as in the first drawing on the left. The valve 55 between the two tanks is kept closed. Once the tanks are positioned, the valve 55 is opened and the system starts to pump. Seawater (FC) enters into the lower tank 60, and the separation fluids FS1 and FS2 from the lower tank move into the central tank 50 towards the upper tank 51. Continuing pumping, seawater will start to fill the central tank 50 arriving at the upper tank 51, and the two fluids FS1 and FS2 will be maintained in between the two. When FS1 and FS2 reach the top of the upper tank 51, the system is recovered.

Example 9A

Use of a Tank with Dividing Walls

A metallic or plastic tank with a length of 9 meters and diameter of 2.1 meters is filled with methanol (FL) (density 792 kg/m$^3$). The tank contains vertical walls which divide it in 10 sectors with approximately the same surface area, so that the equivalent diameter of each sector is approximately 0.6 m. To reduce contact phenomena between the upper chemical and the lower water due to movements of the system, approximately 1400 liters of fluorinated organic compounds (FS) are introduced with density 960 kg/m$^3$ (a mixture of fluoroalkanes C5, C6, C7, C8, C9) which generate a barrier with a height of approximately 0.4 m. The tank is positioned vertically and placed on the sea bottom. Seawater (FC) will be positioned on the bottom of the tank and will enter as the methanol is pumped, compensating the external pressure.

Example 9B

Use of a Tank with Dividing Walls

A metallic tank with a length of 9 meters and diameter of 2.1 meters is filled with methanol (FL) (density 792 kg/m$^3$). The tank contains metallic vertical dividing walls that divide it into various sectors with approximately the same section so as to avoid contact phenomena between the upper chemical and the lower water due to movements of the system. Approximately 1 m$^3$ of chlorinated organic compounds with a density of 970 kg/m$^3$ are inserted (short chain chloroparaffin with 20-30% of chlorine) (FS). The tank is positioned vertically and placed on the sea bottom. Seawater (FC) will be positioned on the bottom of the tank and will enter as the methanol is pumped, compensating the external pressure.

Example 10

Use of Two Tanks; dFS>dFL,dFC

Two horizontal tanks 70,80 positioned in parallel and connected in series (as shown for example in FIG. 12) are filled: one 70 with a solution containing a glycol ether (FL) with a density of 1,050 kg/m$^3$, the other one 80 with perfluorooctane (FS) (Density=1,770 kg/m$^3$) and placed on the sea bottom. The solution is pumped in a subsea pipeline. The vacuum of the first tank 70 is filled by perfluorooctane, while the vacuum of the second tank 80 is filled by seawater (FC).

Example 11

Use of Five Tanks in Series dFS<dFC; dFS>dFL

Five vertical tanks 210,220,230,240,250 with a height of 3.5 m and diameter of 500 mm are positioned in parallel and connected hydraulically in series (bottom-head) by means of appropriate valves/lines 205,206,207 and 208. The first tank 210 on the left is filled with a chloro fluorinated compound (mixture of chlorofluoroalkanes), having a density of 970 kg/m$^3$ (FS). Into the other four tanks there is injected a chemical product (methanol) (FL) having a density of 790 kg/m$^3$. The pump 202 will aspirate from the right-side tank, as the liquid is pumped, seawater (FC) will enter into the first tank 210. The barrier fluid will move from the first tank 210 to the bottom of the second tank 220, and so on until the last one 250 serving as an interface between the two fluids.

Example 12

Use of Five Tanks in Series dFS>dFC and dFS<dFL

Five vertical tanks 310,320,330,340 and 350 with a height of 2.2 m and diameter of 500 mm are positioned in parallel and connected hydraulically in series by means of appropriate valves 305,306,307,308. The first tank 310 on the left is filled with a chlorinated compound (FS) (mixture of chloroparaffins with approximately 30÷35% of chlorine on average), having a density of 1,070 kg/m$^3$. Into the other four tanks is injected a chemical product (diethylene glycol) (FL) having a density of 1,110 kg/m$^3$. The pump 302 aspirates from the right-side tank 350, as the liquid is pumped, seawater (FC) will enter into the upper part of the first tank 310. The separation fluid will move from the bottom of the first tank 310 to the head of the second tank 320, and so on until the last one 350 serving as a barrier (FS) between the two fluids FL and FC.

From the above description of the present disclosure, the advantages offered by the present disclosure will be immediately known to the person skilled in the art.

One of the first advantages to be mentioned is that the application of the present disclosure comprises the use of products that can be selected according to specific needs and confirmation of feasibility requires a reasonable number of experimental tests.

The use of a fluid separation system as proposed by the present patent application considerably simplifies the structure and the mechanical construction of the tank.

In this method its construction costs are low with respect to a typical rigid, plastic or metallic tank with an inner membrane.

The tank may have a duration of very many years, proportionately to the material used for construction, unlike tanks containing a plastic membrane, whose duration or whose efficiency is limited.

Moreover, considering the volume that is not useful for storage purposes, because it is occupied by the barrier fluid, the present disclosure offers an equivalent or better volumetric efficiency (i.e., volume of chemical/usable volume) with respect to a tank that uses a bladder or a membrane.

The operation of a tank according to the present disclosure is simpler than that of tanks with variable volumes, and it is comparable to that of a common onshore tank.

The described system, moreover, is highly flexible, by virtue of the possibility of modifying the density of the bathymetric compensation fluid.

The described tank is easily modifiable in its structure, so as to provide inner dividing walls, thereby allowing use in those operating conditions that could entail oscillations of the system.

Lastly, the described system can be integrated optimally with the systems and techniques for transporting and positioning subsea and subsea tanks.

The invention claimed is:

1. A method for compensating bathymetric pressure inside a subsea tank or a tank in a system of a plurality of subsea tanks, said subsea tank or subsea tanks having an inner diameter, containing a volume of a liquid working fluid (FL) following a change or decrease of the volume of said liquid working fluid (FL), the method comprising:

compensating said change or decrease with an equivalent volume of a liquid bathymetric compensation fluid (FC) represented by seawater, said liquid working fluid (FL) being mutually miscible with said bathymetric compensation fluid (FC), wherein the liquid working fluid (FL) and seawater are separated from each other by a separation layer of a separation fluid (FS), which is liquid under operative conditions and immiscible with said liquid working fluid (FL) and with said bathymetric compensation fluid (FC).

2. The method of claim 1, wherein said separation fluid (FS) has an intermediate density between the density of said liquid working fluid (FL) and the density of said bathymetric compensation fluid (FC).

3. The method of claim 1, wherein said separation fluid comprises a first separation fluid (FS1) and a second separation fluid (FS2), which are immiscible with said liquid working fluid (FL) or with said bathymetric compensation fluid (FC) with which they are respectively in contact.

4. The method of claim 3, wherein the density of said first separation fluid (dFS1) is different from the density of said second separation fluid (dFS2).

5. The method of claim 3, wherein said first separation fluid (FS1) and said second separation fluid (FS2) both have intermediate density between the density of said liquid working fluid (FL) and the density of said bathymetric compensation fluid (FC).

6. The method of claim 3, wherein said separation fluid (FS), said first separation fluid (FS1) and said second separation fluid (FS2) are selected from the group consisting of: chloroalkanes, fluoroalkanes, and mixtures thereof, chloroparaffins and mixtures thereof, chlorosilanes, fluorosilanes, and mixtures thereof.

7. The method of claim 3, wherein to at least one of said liquid working fluid (FL), separation fluid (FS), first separation fluid (FS1), second separation fluid (FS2), and bathymetric compensation fluid (FC) filling bodies made of an appropriate inert, plastic or metallic material, having higher density than that of the liquid working fluid (FL), separating fluid and bathymetric compensation fluid (FC) are added.

8. The method of claim 1, wherein said liquid working fluid (FL) has higher or lower density than the bathymetric compensation fluid (FC).

9. The method of claim 1, wherein the density of the bathymetric compensation fluid (FC) is increased or decreased by adding an appropriate additive.

10. The method of claim 1, wherein said separation layer inside said subsea tank has a thickness between approximately 0.5 and 0.2 times the inner diameter of the subsea tank.

11. The method of claim 1, wherein the density of the separation fluid (FS) is higher than the density of the liquid working fluid (FL) and higher than the density of the bathymetric compensation fluid (FC) or the density of the separation fluid is lower than the density of the liquid working fluid (FL) and lower than the density of the bathymetric compensation fluid (FC) and wherein the liquid working fluid (FL), the separation fluid (FS) and the bathymetric compensation fluid (FC) are never present inside one of the subsea tanks of the system.

12. The method of claim 1, wherein said subsea tank or said subsea tank in a system of a plurality of subsea tanks is in fluid connection with a service tank containing said liquid working fluid (FL) from which said liquid working fluid (FL) is withdrawn and reinjected into said subsea tank or is withdrawn from said subsea tank and reinjected into said service tank.

13. A subsea tank for storing a liquid working fluid (FL) according to the method of claim 1, said subsea tank having a height/inner diameter ratio of approximately ≥7 and comprising separator walls.

14. The subsea tank of claim 13, wherein said separation fluid (FS) comprises a first separation fluid (FS1) and a second separation fluid (FS2), wherein said first and second separation fluids (FS21, FS2) are immiscible with said liquid working fluid (FL) or with said bathymetric compensation fluid (FC) with which they are respectively in contact, and said bathymetric compensation fluid (FC) and said liquid working fluid (FL) are mutually miscible.

15. The subsea tank of claim 14, wherein said subsea tank works as a compensator in fluid connection with a service tank containing said liquid working fluid (FL), which is withdrawn or reinjected into said service tank.

* * * * *